US007993089B2

(12) United States Patent
Enenkel et al.

(10) Patent No.: US 7,993,089 B2
(45) Date of Patent: Aug. 9, 2011

(54) METHOD AND SYSTEM FOR EXTRACTING SORTED MAIL ITEMS IN MAIL PROCESSING SYSTEMS

(75) Inventors: Peter Enenkel, Constance (DE); Klaus Koenig, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 955 days.

(21) Appl. No.: 11/724,398

(22) Filed: Mar. 15, 2007

(65) Prior Publication Data

US 2008/0226433 A1 Sep. 18, 2008

(51) Int. Cl.
*B65B 21/02* (2006.01)

(52) U.S. Cl. ..... 414/404; 414/414; 209/584; 209/900

(58) Field of Classification Search ..... 414/404, 414/414; 209/584, 900
See application file for complete search history.

(56) References Cited

U.S. PATENT DOCUMENTS 6,328,522 B1 * 12/2001 Martz ..... 414/414
6,416,271 B1 * 7/2002 Pigott et al. ..... 414/422
2003/0038065 A1 2/2003 Pippin et al.

* cited by examiner

*Primary Examiner* — Saúl J Rodríguez
*Assistant Examiner* — Willie Berry
(74) *Attorney, Agent, or Firm* — Laurence A. Greenberg; Werner H. Stemer; Ralph E. Locher

(57) ABSTRACT

A system for extracting mail items in a mail processing system includes at least one pocket for containing at least one mail item and an extraction device. The pocket has a bottom area and two lateral walls, wherein each lateral wall has at least one opening. The pocket further includes a release mechanism at the bottom area configured to place the bottom area in an open state and a closed state. The extraction device is configured to engage the lateral walls of the pocket so that contact elements of the extraction device extend through the lateral walls and urge the at least one mail item away from inner surfaces of the lateral walls. The extraction device is further configured to cause the at least one mail item to pass through the bottom area when in the open state.

14 Claims, 4 Drawing Sheets

METHOD AND SYSTEM FOR EXTRACTING SORTED MAIL ITEMS IN MAIL PROCESSING SYSTEMS

BACKGROUND OF THE INVENTION

The various embodiments described herein relate generally to a mail processing system. More particularly, these embodiments relate to a method and system for extracting sorted mail items from pockets used in such a system.

Each day postal services process mail items for delivery to millions of individual domestic addresses. As used throughout this application, mail items refer to letters, magazines, books and other such flat items. Before mail carriers begin to walk through or drive through their delivery routes, a mail processing system at a processing site sorts all mail items for the carriers and prepares the sorted mail items for delivery to a multitude of domestic addresses. A carrier's responsibility includes putting all of these mail items into an appropriate sequence for efficient delivery to the domestic addresses.

The mail processing system is highly automated to handle the amount of daily mail items. Some mail processing systems may include a delivery point packaging (DPP) system that, for example, separates the mail items, reads their destination addresses and groups the mail items based upon their respective destination addresses. U.S. Pub. No. 2003/0038065 describes an automated DPP system that includes casing towers each carrying, on a given number of levels, vertically oriented pockets (slots) with front openings to receive mail items in horizontal direction. The pockets are grouped in containers or pods to receive most or all mail for the respective delivery point. Robots transport the mail items to the pockets, one mail item per robot, and insert them into the pockets. Each robot is equipped with an inserter apparatus configured to extend towards the pocket to insert the mail item into the assigned pocket. After the mail item is inserted, the inserter apparatus retracts and the empty robot returns to a loading station.

In the system described in U.S. Pub. No. 2003/0038065, extraction of the one or more mail items from the pockets occurs in opposite direction to the loading direction, i.e., horizontally through the front opening. Each pocket includes a mechanism that transports the one or more mail items horizontally out of the pocket. This mechanism includes a belt system with a bridge (H-belt) that pushes the mail items out of the pocket. The pocket is, therefore, a complex structure.

SUMMARY OF CERTAIN INVENTIVE ASPECTS

A general aspect of a mail processing system is to operate as efficient and reliable as possible and as inexpensive as possible. One parameter that influences efficiency, reliability, and operating costs is the process of extracting the mail items, in particular how long it takes to empty a pocket and how it is done. There is, therefore, a need for an improved technique for extracting mail items from pockets in a mail processing system.

Accordingly, one aspect involves a method of extracting mail items from a pocket in a mail processing system. A pocket containing at least one mail item resting on a bottom area and between two lateral walls is provided, wherein each lateral wall has at least one opening. An extraction device having contact elements is engaged with the pocket so that the contact elements extend through the at least one opening of each lateral wall and urge the at least one mail item away from inner surfaces of the lateral walls. The bottom area is opened and the extraction device is activated to cause the at least one mail item to pass through the opened bottom area.

Another aspect involves a system for extracting mail items in a mail processing system. The system includes at least one pocket for containing at least one mail item and an extraction device. The pocket has a bottom area and two lateral walls, wherein each lateral wall has at least one opening. The pocket further includes a release mechanism at the bottom area configured to place the bottom area in an open state and a closed state. The extraction device is configured to engage the lateral walls of the pocket so that contact elements of the extraction device extend through the lateral walls and urge the at least one mail item away from inner surfaces of the lateral walls. The extraction device is further configured to cause the at least one mail item to pass through the bottom area when in the open state.

The various embodiments of the system and method described herein allow the pocket to be emptied through the bottom area. Advantageously, containers, conveyor belts or other processing equipment can be arranged below the pockets and the structure that carries the pockets. Further, there is no need to introduce a device into the pocket to remove the mail items from a pocket. The complexity of the system as a whole and the complexity of the pockets are reduced, which improves the reliability of the mail processing system. The system and method described herein provide generally for an increased throughput of mail through the mail processing system so that a more efficient mail processing is possible.

BRIEF DESCRIPTION OF THE DRAWINGS

These and other aspects, advantages and novel features of the embodiments described herein will become apparent upon reading the following detailed description and upon reference to the accompanying drawings. In the drawings, same elements have the same reference numerals. In the following list of figures.

DETAILED DESCRIPTION OF CERTAIN INVENTIVE EMBODIMENTS

Figure 1:
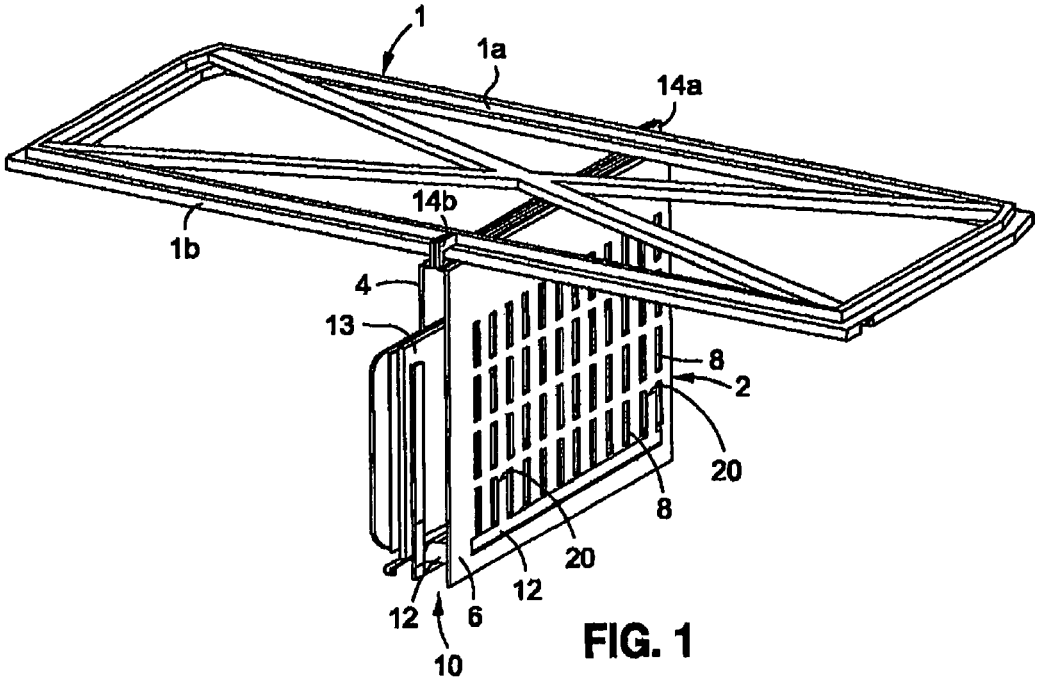
FIG. 1 depicts a schematic illustration of one embodiment of an arrangement of a guide and pockets of a mail processing system.

FIG. 1 shows a schematic illustration of one exemplary embodiment of an arrangement of a guide 1 and pockets 2. For ease of illustration, FIG. 1 shows one pocket 2; however, it is contemplated that the guide 1 carries a plurality of pockets 2, for example, between about 10 and about 30. Such a guide 1 may be referred to as a pod. Each pocket 2 represents, for example, an individual destination address of a mail recipient. However, it is contemplated that the pocket 2 may be filled according to other criteria, such as post codes or addressee names.

The pocket 2 is configured to contain at least one mail item between two lateral walls 4, 6 and supported by a bottom area 10. The lateral walls 4, 6 have support elements 14*a*, 14*b* to secure the pocket 2 to rails 1*a*, 1*b* of the guide 1. The support elements 14*a*, 14*b* allow the lateral walls 4, 6 to move along the rails 1*a*, 1*b*, and with respect to each other. This allows the pocket 2 to expand in direction of the rails 1*a*, 1*b*, i.e., to "breath" depending on the number of mail items contained in the pocket 2. That is, the pocket 2 widens as a function of the number of mail items loaded to the pocket 2 via an open front side. In one embodiment, the pocket 2 is loaded using a slip sheet 13 similar to the loading described in the above mentioned U.S. Pub. No. 2003/0038065. In FIG. 1, the slip sheet 13 is shown as being introduced into the pocket 2.

Each lateral wall 4, 6 has at least one opening 8. In the illustrated embodiment, each lateral wall 4, 6 has vertical rows of individual openings 8, wherein each opening 8 has a rectangular shape. The number and size of the openings 8 is dependent on a particular kind of extraction device 16 used to extract the at least one mail item from the pocket 2. Details of the extraction device 16 are described below with reference to FIG. 2.

Figure 3A:
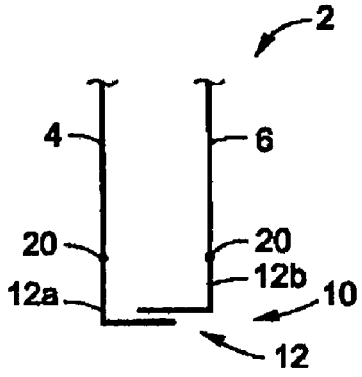
FIG. 3*a* depicts a schematic illustration of a pocket with a closed bottom area according to a first embodiment.
Figure 4A:
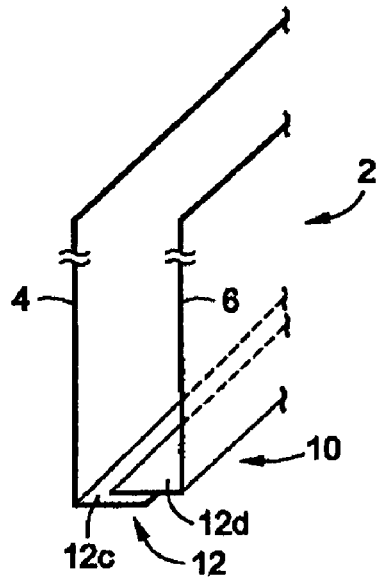
FIG. 4*a* depicts a schematic illustration of a pocket with a closed bottom area according to a second embodiment.
Figure 3B:
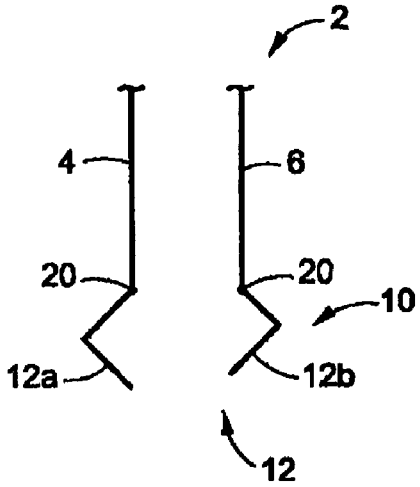
FIG. 3*b* depicts a schematic illustration of the pocket with an open bottom area according to the first embodiment.
Figure 4B:
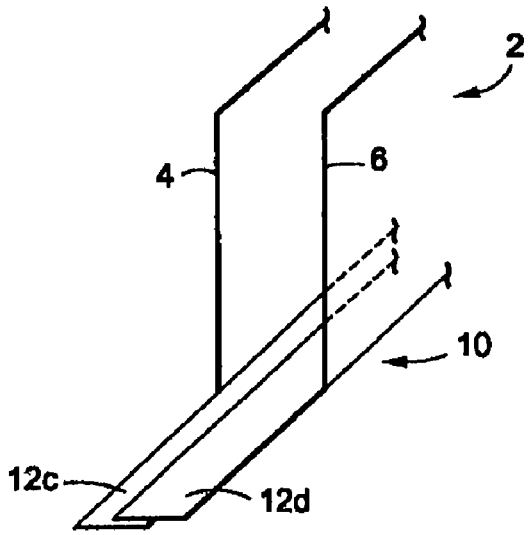
FIG. 4*b* depicts a schematic illustration of the pocket with an open bottom area according to the second embodiment.

The pocket 2 includes further a release mechanism 12 at the bottom area 10 and configured to place the bottom area 10 in an open state and a closed state. The release mechanism 12 can be configured, for example, similar to a trap door mechanism, as illustrated in FIGS. 3*a* and 3*b*, or similar to a drawer mechanism, as illustrated in FIGS. 4*a*, 4*b*. In the embodiment of FIG. 1, the release mechanism 12 is visible at the open front side and the lateral wall 6 in proximity of the bottom area 10. Once the release mechanism 12 places the bottom area 10 in the open state, the mail item falls through the open bottom area 10 in a container or onto a conveyor belt for further processing.

Figure 2A:
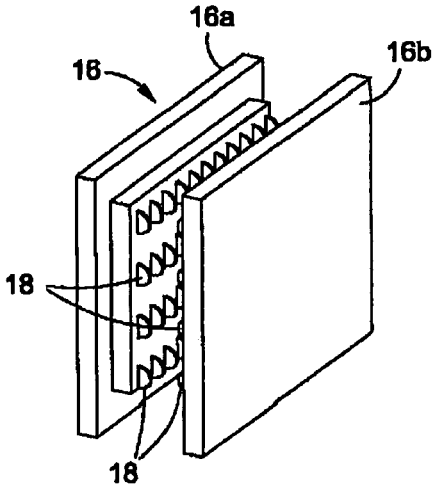
FIG. 2*a* depicts a schematic illustration of a first embodiment of an extraction device.

FIG. 2*a* depicts a schematic illustration of a first embodiment of the extraction device 16. The extraction device 16 has support elements 16*a*, 16*b* and contact elements 18 provided on the support elements 16*a*, 16*b*. The extraction device 16 is configured to engage the lateral walls 4, 6 of the pocket 2 so that the contact elements 18 extend through the openings 8 and urge the at least one mail item away from inner surfaces of the lateral walls 4, 6. Once the extraction device 16 is engaged, the contact elements 18 cause the at least one mail item contained in the pocket 2 to pass through the bottom area 10 when in the open state.

The contact elements 18 are driven to exert a downward force on the mail item to overcome any frictional force between the mail item and the neighboring lateral walls 4, 6. When the extraction device 16 is engaged, the contact elements 18 first urge any curved or bent mail item away from the lateral walls 4; the exerted downward force then urges the mail item downwards. Hence, the extraction device 16 ensures that even curved or bent mail items, which might otherwise get stuck between the lateral walls 4, 6, are extracted from the pocket 2.

In one embodiment, the contact elements 18 are configured as rollers, as shown in FIG. 2*a*. The rollers are mounted to the support elements 16*a*, 16*b* so that each roller rotates upon activation by a drive unit (not shown). The number and size of the contact elements 18 and the number and size of the openings 8 are adapted to each other, for example, so that each opening 8 receives a roller.

Figure 2B:
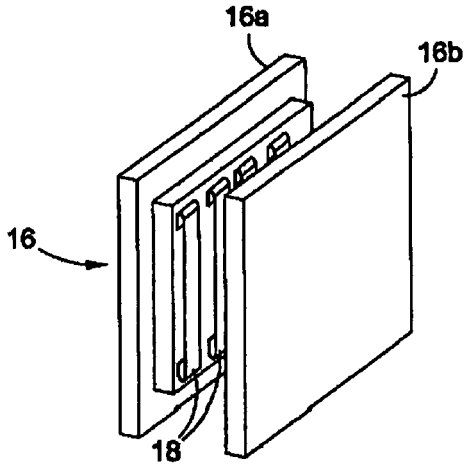
FIG. 2*b* depicts a schematic illustration of a second embodiment of an extraction device.

In another embodiment, the contact elements 18 are configured as rotatable belts, as shown in FIG. 2*b*. The belts are mounted to the support elements 16*a*, 16*b*, for example, at least one belt on each support element 16*a*, 16*b*, so that each belt rotates upon activation by a drive unit (not shown). The number and size of the contact elements 18 and the number and size of the openings 8 are adapted to each other, for example, so that each opening 8 receives a belt.

It is contemplated that the invention is not limited to the rollers and belts shown in FIGS. 2*a* and 2*b*, respectively. In certain embodiments, belts and rollers may be combined. For example, belts may be used in areas where surface areas of mail items can usually be found, and rollers may be used where corners or edges of a mail items may exist.

Further, the number of contact elements 18 may be varied as long as a sufficient downward force is exerted on the mail items to ensure their extraction from the pocket 2. It is further contemplated that the pockets 2 are provided at the inner surfaces with sliding surfaces that minimize the friction between the mail items and the pocket walls.

FIGS. 3*a* and 3*b* depict a schematic illustration of a pocket 2 with a closed bottom area 10 and an open bottom area 10, respectively, according to a first embodiment. The release mechanism 12 is configured as a trap door mechanism having door elements 12*a*, 12*b*. Each door element 12*a*, 12*b* is mounted to the respective lateral wall 4, 6 via at least one joint 20. In the embodiment of FIG. 1, two joints 20 are used to mount the door elements to the lateral walls 4, 6. The joints 20 allow the door elements 12*a*, 12*b* to swivel between the closed and open states. In the illustrated embodiment, a door element 12*a*, 12*b* has at least a vertical part connected to the at least one joint 20, and at least one horizontal part connected to the vertical part, e.g., at about 90°, or at a slightly larger angle to cause the mail items to move towards the center of the pocket 2. As shown in FIG. 3*a*, the horizontal parts overlap to ensure that the pocket 2 remains in the closed state even if the distance between the lateral walls 4, 6 increases, e.g., when the pocket 2 "breathes."

It is contemplated that the release mechanism 12 may be implemented in various ways, for example, by varying the location of one or more pivot points. One option is provided by the door elements 12*a*, 12*b* shown in FIGS. 3*a*, 3*b* that are configured to swivel about the joints 20. Alternatively, the release mechanism 12 may have only one door element configured to swivel about the joints 20. In a further alternative, one of the lateral walls 4, 6 may be configured to swivel while the other remains in its vertical position.

FIGS. 4*a* and 4*b* depict a schematic illustration of a pocket 2 with a closed bottom area and an open bottom area, respectively, according to a second embodiment. The release mechanism 12 is configured as a drawer mechanism having drawer elements 12*c*, 12*d*. In proximity of the bottom area, the lateral walls 4, 6 are configured to allow the drawer elements 12*c*, 12*d* to slide in (closed state) and out (open state) of the pocket 2, for example, along guide rails (not shown). As shown in FIG. 4*a*, the drawer elements 12*c*, 12*d* overlap to ensure that the pocket 2 remains in the closed state even if the distance between the lateral walls 4, 6 increases. In one embodiment, the drawer elements 12*c*, 12*b* are pulled out at about the same time as the slip sheet 13 is pulled out.

Figure 5A:
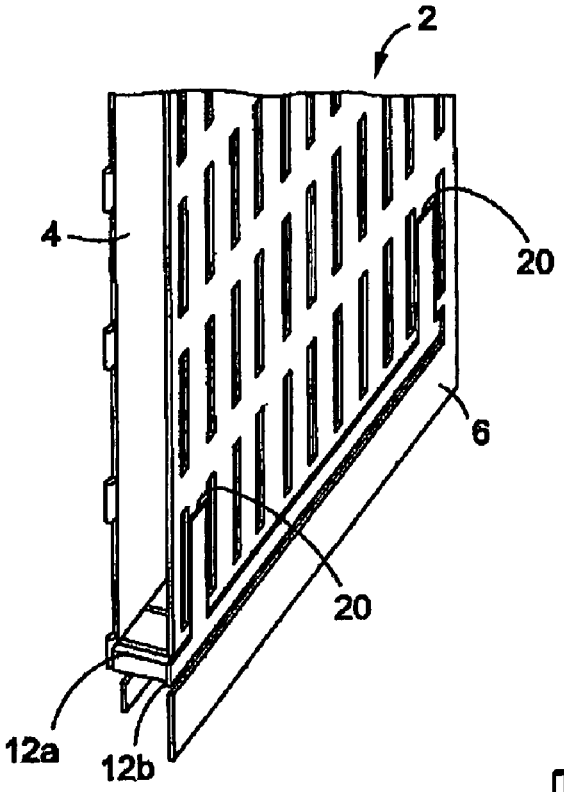
FIG. 5*a* depicts an enlarged section of a pocket in a first state.
Figure 5B:
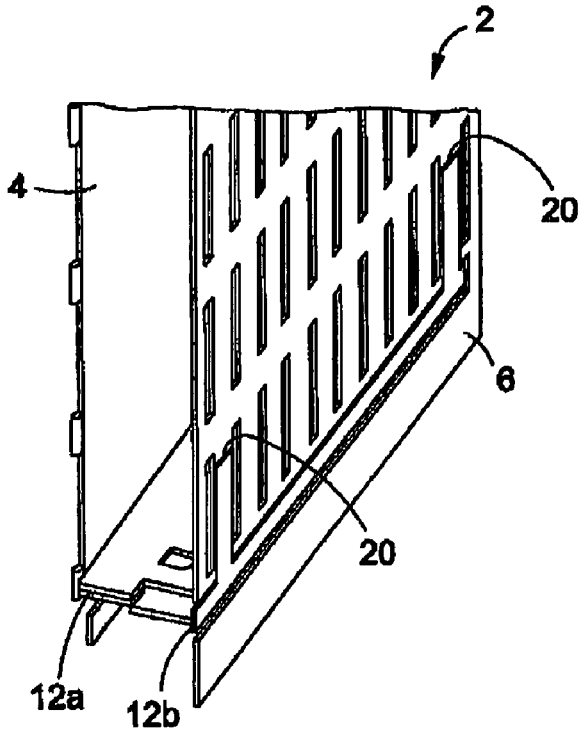
FIG. 5*b* depicts an enlarged section of the pocket in a second state.

FIGS. 5*a* and 5*b* depict an enlarged section of the pocket 2 provided with a trap door mechanism, as described with reference to FIGS. 3*a* and 3*b*. FIG. 5*a* depicts the enlarged section of the pocket 2 in a first state, i.e., with a distance between the lateral walls 4, 6 at a minimum, e.g., when the pocket 2 is empty, or contains only a few thin mail items. FIG. 5*b* depicts the enlarged section of the pocket 2 in a second state, i.e., with an increased distance between the lateral walls 4, 6 due to a higher number of loaded mail items. As shown in FIG. 5*b*, the overlapping door elements 12*a*, 12*b* provide that the pocket 2 remains in the closed state even if the distance between the lateral walls 4, 6 increases.

FIGS. 5*a* and 5*b* show further that the door elements 12*a*, 12*b* may be configured as interleaved elements. For example, each door element 12*a*, 12*b* has a comb-like structure so that the teeth of one element reach towards the gaps between the teeth of the other element. It is contemplated that the comb-like structure is configured that, independent of the distance between the lateral walls 4, 6, the mail items experience no steps or obstacles that may hinder the mail items' extraction.

Regardless of a particular embodiment of the release mechanism 12, the surface upon which the mail items rest in the closed state has a structure that does not hinder the mail item's ability to move within the pocket 2. Further, the release mechanism 12 is configured to allow the lateral walls 4, 6 to move along the rails 1*a*, 1*b*. Stops or other elements restrict the distance between the lateral walls 4, 6, i.e., the stops limit the extent the pocket 2 can expand in direction of the rails 1*a*, 1*b*.

The release mechanism 12 may be made of metal, a plastic material, or a combination of metal and plastic material. Metal may be deep drawn into a predetermined form, and a plastic material may be injection molded.

The release mechanism 12 may be activated in various ways. In one embodiment, the release mechanism 12 is activated by a relative movement between the lateral walls 4, 6 and the extraction device 16. In another embodiment, the release mechanism 12 is activated by one or more actuators at the extraction device 16. In yet a further embodiment, the release mechanism 12 is activated by an actuator at the pocket 2 via an external signal.

There are several options for causing the contact elements 18 to extend through the openings 8. The support elements 16*a*, 16*b* of the extraction device 16 may be configured to detect the position and orientation of the lateral walls 4, 6 and to move towards the lateral walls 4, 6 as a function of the detected position and orientation. In another embodiment, the support elements 16*a*, 16*b* move for a predetermined distance towards the lateral wall 4, 6 so that one ("first") support element 16*a*, 16*b* reaches one ("first") of the lateral wall 16*a*, 16*b* before the other ("second") support element 16*a*, 16*b* reaches the other ("second") lateral wall 16*a*, 16*b*. In that case, the "first" support element 16*a*, 16*b* presses the "second" lateral wall 4, 6 against the "second" support element 16*a*, 16*b*. In yet another embodiment, one or more actuators may move the lateral walls 4, 6 towards the support elements 16*a*, 16*b* of the extraction device 16.

Figure 6A:
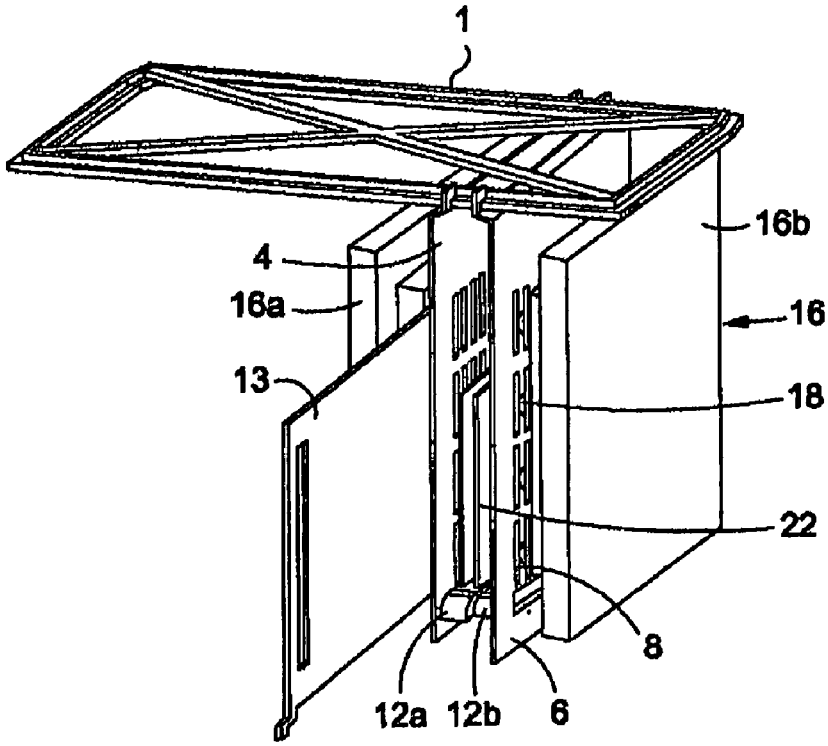
FIGS. 6*a* and 6*b* depict one embodiment of extracting mail items from a pocket.
Figure 6B:
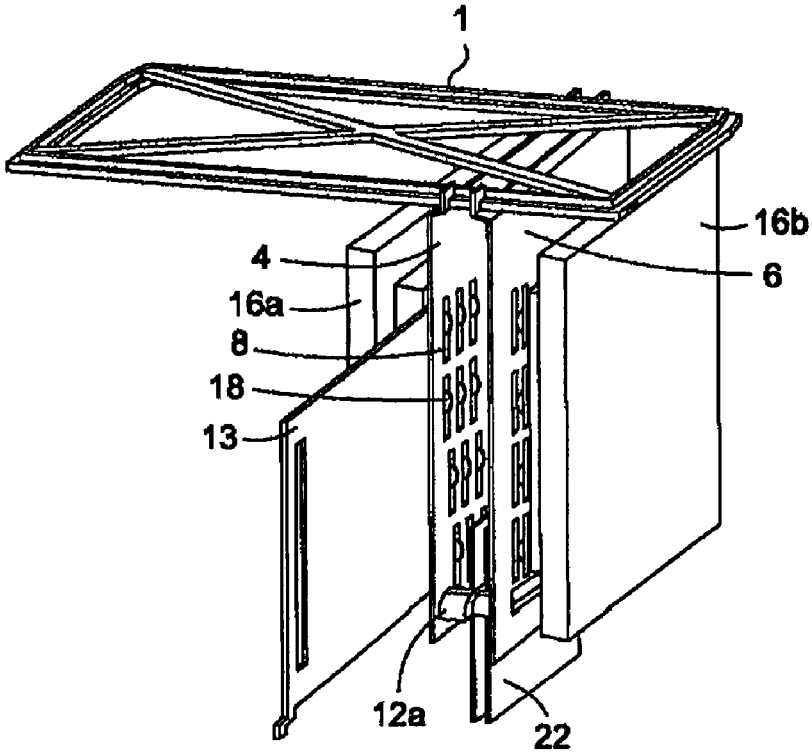

FIGS. 6*a* and 6*b* depict one embodiment of how at the least one mail item 22 is extracted from a pocket 2. The extraction of the mail item 22 is performed at an unloading station. In FIG. 6*a*, the pocket 2 containing at least one mail item 22 is positioned between the support elements 16*a*, 16*b* of the extraction device 16. The pocket 2 is in the closed state. To position the pocket 2 and the extraction device 16 as shown in FIG. 6*a*, the pocket 2 or the extraction device 16, or both, may be moved. At this time, the extraction device 16 does not yet fully engage the pocket 2 so that the contact elements 18 do not yet extend through the openings 8.

As soon as the pocket 2 is positioned within the extraction device, the slip sheet 13 is pulled out. The support elements 16*a*, 16*b* then move towards the lateral walls 4, 6 to fully engage the pocket 2 and the contact elements 18 extend through the openings, as shown in FIG. 6*b*. The support elements 16*a*, 16*b* move towards the lateral walls 4, 6 until the contact elements 18 urge the mail item 22 away from the lateral walls 4, 6. The contact elements 18 (e.g., rollers) are activated and the release mechanism 12 (e.g., a trap door mechanism) is activated to place the pocket 2 in the open state. The activated contact elements 18 exert a downward force that is greater than any frictional force between the mail item 22 and the lateral walls 4, 6 and the mail item 22 falls out of the pocket 2, as shown in FIG. 6*b*.

It is apparent that there has been disclosed an apparatus and method for extracting mail items from a pocket that fully satisfy the objects, means, and advantages set forth hereinbefore. For example, the embodiments provide for a less complex pocket 2 as the pocket 2 itself is not provided with an active extraction mechanism. Instead, the extraction device 16 engages the pocket 2 only at the unloading station. Further, due to the unloading via the bottom area 10 less time is required for unloading.

The invention claimed is:

1. A method of extracting mail items from a pocket in a mail processing system, comprising:

providing a pocket containing at least one mail item resting on a bottom area and between two lateral walls, each lateral wall having at least one opening;

engaging an extraction device having contact elements with the pocket so that the contact elements extend through the at least one opening of each lateral wall and urge the at least one mail item away from inner surfaces of the lateral walls;

opening the bottom area; and activating the extraction device to cause the at least one mail item to pass through the opened bottom area.

2. The method of claim 1, wherein said engaging comprises positioning the pocket between support elements of the extraction device, each support element carrying at least one contact element.

3. The method of claim 2, wherein said engaging further comprises moving at least one of the support elements towards one of the lateral walls.

4. The method of claim 1, wherein said opening comprises activating a release mechanism comprising a trap door mechanism, wherein upon activation door elements of the trap door mechanism swivel about joints that connect the door elements to the lateral walls.

5. The method of claim 1, wherein said opening comprises activating a release mechanism comprising a drawer mechanism, wherein upon activation drawer elements of the drawer mechanism are at least partially pulled out of the pocket in proximity of the bottom area.

6. The method of claim 1, wherein activating the extraction device includes activating the contact elements, each contact element comprising a roller configured to exert a force acting on the at least one mail item.

7. The method of claim 1, wherein activating the extraction device includes activating the contact elements, each contact element comprising a rotatable belt configured to exert a force acting on the at least one mail item.

8. A system for extracting mail items in a mail processing system, comprising:

a pocket for containing at least one mail item, wherein the pocket has a bottom area and two lateral walls, each lateral wall having at least one opening, wherein the pocket further has a release mechanism at the bottom area configured to place the bottom area in an open state and a closed state;

an extraction device configured to engage the lateral walls of the pocket so that contact elements of the extraction device extend through the at least one opening in the lateral walls and urge the at least one mail item away from inner surfaces of the lateral walls; and a drive unit;

wherein at least one contact element is configured as a rotatable belt or roller capable of rotating upon activation by the drive unit in order to exert downward force on the mail items; and wherein the extraction device is configured to cause the at least one mail item to pass through the bottom area when in the open state.

9. The system of claim 8, wherein the extraction device comprises two support elements, each support element carrying at least one contact element, wherein the extraction device is configured to receive the pocket between the support elements.

10. The system of claim 8, wherein the release mechanism comprises a trap door mechanism, wherein upon activation door elements of the trap door mechanism swivel about joints that connect the door elements to the lateral walls.

11. The system of claim 8, wherein the release mechanism comprises a drawer mechanism, wherein upon activation drawer elements of the drawer mechanism are configured to be at least partially pulled out of the pocket in proximity of the bottom area.

12. The system of claim 8, wherein each contact element comprises a rotatable belt configured to exert a force acting on the at least one mail item.

13. A system for extracting mail items in a mail processing system, comprising:

a pocket for containing at least one mail item, wherein the pocket has a bottom area and two lateral walls, each lateral wall having at least one opening, wherein the pocket further has a release mechanism at the bottom area configured to place the bottom area in an open state and a closed state; and an extraction device configured to engage the lateral walls of the pocket so that contact elements of the extraction device extend through the lateral walls and urge the at least one mail item away from inner surfaces of the lateral walls, wherein at least one of the contact elements is a rotatable belt configured to exert a force acting on the at least one mail item and the extraction device is configured to cause the at least one mail item to pass through the bottom area when in the open state.

14. The system of claim 8, wherein:

at least one contact element is configured as a rotatable belt; and at least one contact element is configured as a rotatable roller.

* * * * *